US009038805B2

(12) United States Patent
Crist et al.

(10) Patent No.: US 9,038,805 B2
(45) Date of Patent: May 26, 2015

(54) SELF-SERVICE KIOSK VALIDATOR BRIDGE

(71) Applicant: Bank of America Corporation, Charlotte, NC (US)

(72) Inventors: Kristy M. Crist, Charlotte, NC (US); Terrelle Carswell, Jr., Charlotte, NC (US); Eric McConnell, Cornelius, NC (US); Rahul Puri, Charlotte, NC (US); Devin D. Rhodes, Lexington, KY (US); James D. Goodwin, Kansas City, MO (US)

(73) Assignee: Bank of America Corporation, Charlotte, NC (US)

( * ) Notice: Subject to any disclaimer, the term of this patent is extended or adjusted under 35 U.S.C. 154(b) by 0 days.

(21) Appl. No.: 13/890,440

(22) Filed: May 9, 2013

(65) Prior Publication Data

US 2014/0332341 A1 Nov. 13, 2014

(51) Int. Cl.

| | |
|---|---|
| ***G07F 7/04*** | (2006.01) |
| ***G07D 7/00*** | (2006.01) |
| *G07D 11/00* | (2006.01) |

(52) U.S. Cl.

CPC .. *G07D 7/00* (2013.01); *G07F 7/04* (2013.01); *G07D 11/0066* (2013.01); *G07D 11/0072* (2013.01)

(58) Field of Classification Search

CPC . G07D 7/00; G07D 11/0066; G07D 11/0072; G07F 7/04

USPC ..... 194/206, 302; 235/379; 209/534; 705/42, 43; 902/17, 38, 40

See application file for complete search history.

(56) References Cited

U.S. PATENT DOCUMENTS

| | | | | |
|---|---|---|---|---|
| 4,542,287 | A * | 9/1985 | Watanabe | 235/379 |
| 5,945,602 | A | 8/1999 | Ross | |
| 6,073,837 | A | 6/2000 | Milne | |
| 6,523,742 | B1 * | 2/2003 | Awatsu et al. | 235/379 |
| 7,347,359 | B2 | 3/2008 | Boyes et al. | |
| 7,638,746 | B2 | 12/2009 | Jespersen | |
| 7,856,401 | B2 | 12/2010 | Ross et al. | |

FOREIGN PATENT DOCUMENTS

EP 1843303 10/2007

OTHER PUBLICATIONS

"Diebold Opteva Divert/ Retract ATM Cassette—Tamper-Indicating," DieboldDirect.com, Feb. 17, 2013. ( 1 page).

"Bank ATMs stop sucking in cash after RBI direction," EconomicTimes.com, Sep. 23, 2012, (2 pages).

* cited by examiner

*Primary Examiner* — Mark Beauchaine

(74) *Attorney, Agent, or Firm* — Weiss & Arons LLP; Michael A. Springs, Esq.

(57) ABSTRACT

Apparatus and methods for a self-service kiosk ("SSK") validator bridge are provided. The SSK may include a bridge linking a dispenser and a validator. The bridge may be configured to transfer a tangible item from the validator to the dispenser. The validator may examine the tangible item prior to a dispensing of the tangible item to a SSK customer. The tangible item may be retracted by the dispenser. The bridge may transfer the tangible item from the dispenser to the validator. The SSK may include an acceptor. The bridge may link the acceptor to the validator. The bridge may be configured to transfer a deposit from the acceptor to the validator. The validator may examine the deposit.

18 Claims, 7 Drawing Sheets

SELF-SERVICE KIOSK VALIDATOR BRIDGE

FIELD OF TECHNOLOGY

Aspects of the invention relate to reducing costs associated with automated teller machine ("ATM") mis-dispense claims.

BACKGROUND

ATMs provide banking customers an ability to access bank account information, deposit funds and withdraw cash. ATMs may often obviate the need for a banking customer to consult a human clerk. Additionally, ATMs may be located in a variety of diverse locations remote from banking centers. For example, ATMs may be placed on street corners, in convenience stores, supermarkets or sports arenas.

In a typical ATM transaction, the customer may submit a request for a withdrawal of an amount of cash. The ATM may determine whether the customer has a bank account balance corresponding to, at least, a value of the requested funds. If the customer has sufficient bank account balance, the ATM may dispense the requested amount of cash.

The ATM may present the requested amount of cash to the customer. If the customer does not collect all of the dispensed cash, the ATM may be configured to retract uncollected cash. The ATM may be configured to wait for an expiration of a "time out" period before retracting cash.

An ATM customer may not retrieve all, or a portion of, dispensed cash because of an ATM malfunction. For example, the customer may submit a request for $80.00 in twenty-dollar notes and the ATM may erroneously dispense the requested $40.00 in ten-dollar notes. As a further example, the ATM may not provide sufficient time for the customer to become aware that the cash has been dispensed. The ATM may retract cash before the customer has time to collect dispensed cash.

In response to a retraction of cash by the ATM, a customer may submit a mis-dispense claim. The customer may submit the mis-dispense claim to an operator of the ATM. The customer may submit the mis-dispense claim to an entity responsible for managing a bank account of the customer.

The customer may request a credit for uncollected cash retracted by the ATM. The customer may request that because cash was retracted by the ATM, the account of the customer should not be debited. The customer may allege that none or a portion of a requested amount of cash was collected by the customer.

A wide variety of ATM locations and lack of close supervision at an ATM increases a risk that a customer may submit an unwarranted mis-dispense claim. For example, the customer may intentionally collect only a portion of dispensed cash. The customer may then submit a mis-dispense claim alleging not to have collected any of the dispensed cash. Unwarranted mis-dispense claim have become so prevalent that some ATM operators have disabled a cash retraction feature of ATMs.

It would be desirable to provide a solution that examines cash retracted by an ATM following an unsuccessful customer withdrawal. Examination of retracted cash may provide information useful in a processing of mis-dispense claims and fraud research. For example, the examination may provide details such as denomination, number of bills retracted and a transaction identifier associated with the retraction.

Additionally, a requirement to replenish a cash supply of the ATM is a cost of operating an ATM or a network of ATMs. Typically, ATMs may be refilled between bi-weekly to per day. Some ATMs in busy locations must be refilled twice a day. ATM operators may be reluctant to stock ATMs with additional cash because until the cash is dispensed from the ATM the cash is idling, increasing an opportunity cost of the cash. Restricting the amount of cash that may be withdrawn by a customer may inconvenience and irritate the customer. Armored personnel and services are typically employed to deliver cash to an ATM, further increasing the cost of replenishing the cash supply of an ATM.

An examination of cash dispensed or retracted by an ATM may indicate that a cash inventory of the ATM is not being efficiently utilized. Obtaining accurate information relating to cash dispensing or retracting may allow an ATM operator to better manage a cash inventory of an ATM or network of ATMs.

For example, an ability to examine cash prior to dispensing the cash may verify that genuine notes of the correct denomination are being dispensed from the ATM. The examination may reduce a cost of dispensing counterfeit notes, non-currency items or incorrect denominations that may have been erroneously loaded into the ATM. Detection of an erroneous loading of cash into the ATM may identify a human error or a process breakdown related to cash inventory.

Therefore, it would be desirable to obtain detail associated with cash dispensed or retracted from an ATM. It would be desirable to obtain transaction detail associated with cash dispensed or retracted from an ATM. The transaction detail may supply information used in managing cash supplied to an ATM.

Therefore, it would be desirable to provide apparatus and methods for a self-service kiosk validator bridge.

BRIEF DESCRIPTION OF THE DRAWINGS

The objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
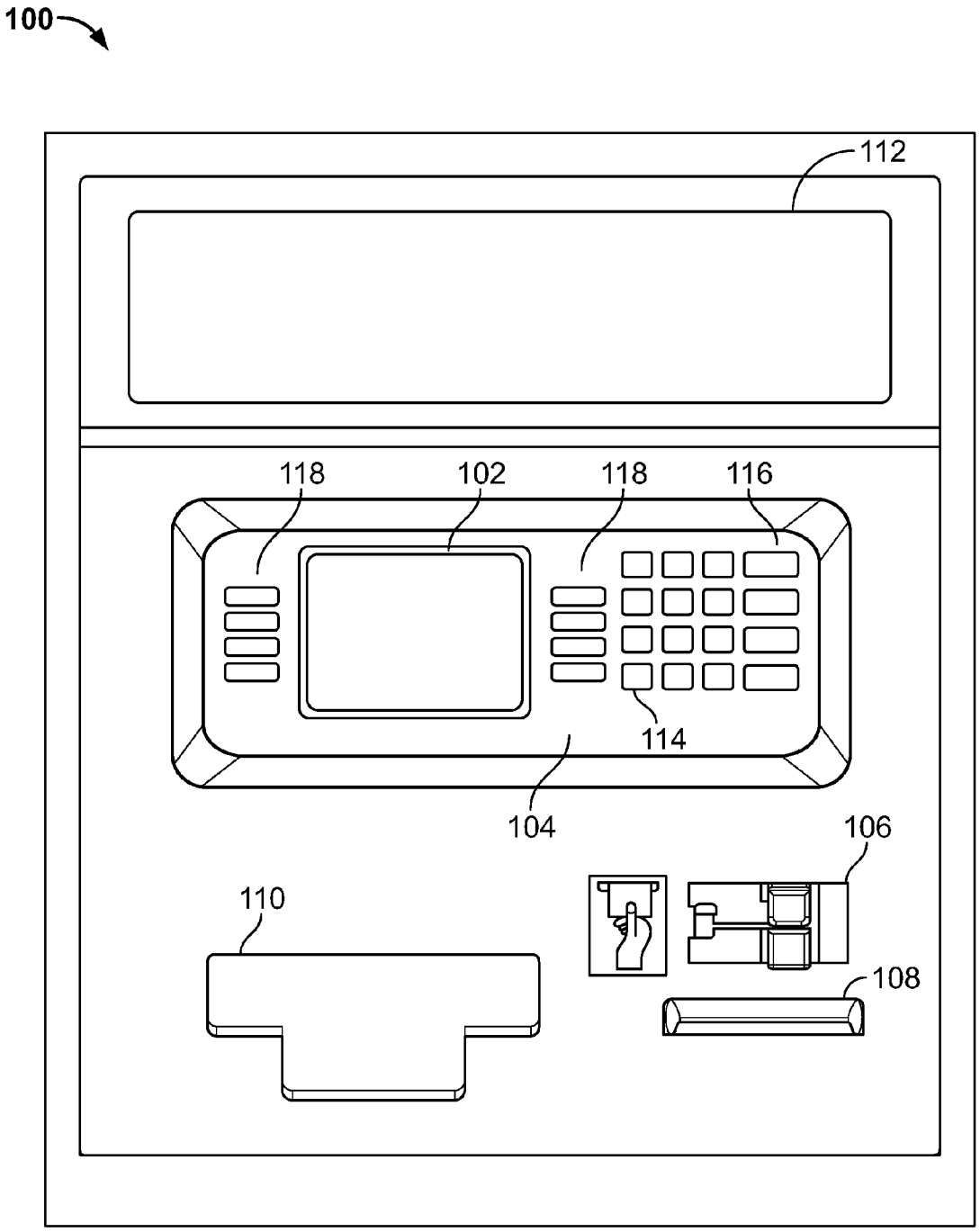
FIG. 1 shows an illustrative apparatus in accordance with principles of the invention.

Apparatus and methods for a self-service kiosk validator bridge are provided. The apparatus may include a self-service kiosk (hereinafter, "SSK"). The SSK may dispense tangible items. The SSK may accept a deposit of a tangible item. The SSK may retract a dispensed tangible item.

The SSK may include a validator. The validator may be configured to examine a tangible item. The tangible item may be any suitable tangible item. For example, the tangible item may include currency, bank notes, event tickets, transportation tickets, lottery tickets and airline boarding passes.

The SSK may include a dispenser. The dispenser may be configured to present the tangible item to a customer. The dispenser may present the tangible item to the customer in response to a request submitted by the customer. The dispenser may be configured to retract the tangible item. The dispenser may be configured to retract the tangible item after the tangible item is dispensed. The dispenser may be configured to retract the tangible item after expiration of a "time out" period. The time out period may be any suitable period of time such as five seconds, ten seconds, fifteen seconds, one minute or five minutes.

The SSK may include a dispenser bridge. The dispenser bridge may be configured to transfer the tangible item. The dispenser bridge may link the dispenser and the validator. The link may be a mechanical link.

For example, after cash is dispensed via the dispenser, the SSK may wait for a customer to withdraw the cash. If the customer does not withdraw all the dispensed cash within fifteen seconds, the SSK may be configured to retract cash remaining in the dispenser. The retracted cash may be transferred from the dispenser to the validator via the dispenser bridge. The dispenser bridge may be configured to transfer any suitable tangible item.

The dispenser bridge may include a sensor. The sensor may detect the tangible item as it is transferred over the dispenser bridge. The sensor may be configured to register a time and date of a transfer of the tangible item via the dispenser bridge.

The SSK may include an acceptor. The acceptor may be configured to receive a deposit from the customer. The deposit may include any suitable tangible item. For example, the deposit may include cash, checks, or coins. The SSK may include an acceptor bridge. The acceptor bridge may link the acceptor and the validator. The link may be a mechanical link. The acceptor bridge may be configured to transfer the tangible item deposited at the SSK. The acceptor bridge may be configured to transfer the tangible item from the acceptor to the validator.

The validator may be configured to receive one or more tangible items retracted by the dispenser and one or more tangible items received by the acceptor. The validator may be "shared" by the dispenser and the acceptor. The validator may examine a tangible item. The validator may examine a retracted tangible item. The retracted tangible item may be transferred from the dispenser to the validator via the dispenser-bridge. The validator may examine a deposited tangible item. The deposited tangible item may be transferred from the acceptor to the validator via the acceptor bridge.

Examination of a tangible item may provide details such as denomination, number of items retracted and a transaction identifier associated with the retraction or deposit. The validator may be configured to perform one or more examination routines. The validator may be configured to perform a first examination routine when the tangible item is transferred via the acceptor bridge. The validator may be configured to perform a second examination routine when the tangible item is transferred via the dispenser bridge.

The first validation routine may include a first set of validation criteria. The second validation routine may include a second set of validation criteria. The second set may include more validation criteria than the first set. The first set may include more validation criteria than the second set.

The SSK may include a purge-bin. The purge-bin may store one or more tangible items retracted by the dispenser. The SSK may include a purge-bridge. The purge-bridge may link the validator and the purge-bin. The purge-bridge may mechanically link the validator and the purge-bin. The purge-bridge may be configured to transfer any suitable tangible item. The purge-bridge may transfer a tangible item from the validator to the purge-bin.

The SSK may include a processor. The processor may be configured to relate a first transaction identifier to a second transaction identifier. The first transaction identifier may be associated with a first amount of currency. The first transaction identifier may correspond to a dispensing of a first amount of currency to the customer. The second transaction identifier may be associated with a second amount of currency. The second transaction may correspond to a retraction of the second amount of currency into the SSK. The second amount of currency may be transferred over the dispenser bridge.

The relationship between the first transaction identifier and the second transaction identifier may associate a first amount of currency dispensed with a second amount of currency retracted by the SSK. The first and second transaction identifiers may each be associated with a customer and/or a customer account.

Based on a relationship between the first transaction identifier, the second transaction identifier and the customer, the processor may generate a fraud record. The fraud record may include the customer account, the first amount of currency, the second amount of currency and a difference between the first amount and the second amount. The difference between may correspond to cash retrieved by the customer. The account of the customer may be debited based on the difference.

For example, the customer may request a withdrawal of $100.00. The SSK may dispense $100.00 and the customer may only retrieve $80.00. The remaining $20.00 may be retracted by the SSK. A fraud record may be generated that indicates that the customer likely retrieved $80.00. An operator of the SSK may debit the account of the customer not more than $80.00. The operator of the SSK may deny a mis-dispense claim alleging that less than $80.00 was retrieved by the customer from the SSK.

Based on a relationship between one or more transaction identifiers, an SSK operator may disable a retraction feature of an SSK. For example, if a threshold number of retractions are associated with a customer, the SSK operator may disable a retraction feature during an SSK session initiated by the customer. The retraction feature may remain disabled for a period of time.

Information included in a fraud record may be used to determine cash use of a SSK. For example, a fraud record may be generated each time a SSK retracts currency. The fraud records may be analyzed to determine if the SSK is malfunctioning, and therefore underutilizing a currency inventory. The fraud records may be analyzed to determine if customers do not wish to accept a particular denomination or form of currency. An operator of the SSK may adjust currency supplied to the SSK or network of SSKs accordingly.

The validator may include a first currency receiver. The first currency receiver may be affixed to the acceptor bridge. The first currency receiver may join the validator to the acceptor bridge. A tangible item, such as currency, that is deposited into the SSK may be transferred to the validator via the first currency receiver.

The validator may include a second currency receiver. The second currency receiver may be affixed to the dispenser bridge. The second currency receiver may join the validator to the dispenser bridge. Retracted currency may be transferred to the validator via the second currency receiver.

Currency retracted by the dispenser may be transferred from the dispenser over the dispenser bridge to the validator via the second currency receiver. A deposit of a customer received at the acceptor may be transferred over the acceptor bridge to the validator via the first currency receiver.

The acceptor bridge may include a first end affixed to the acceptor. The acceptor bridge may include a second end affixed to the first currency receiver. The acceptor bridge may include a span between the first end and the second end of the acceptor bridge.

The dispenser bridge may include a first end affixed to the dispenser. The dispenser bridge may include a second end affixed to the second currency receiver. The dispenser bridge may include a span between the first end and the second end of the dispenser bridge.

Apparatus may include a SSK that includes a dispenser configured to present a first tangible item to a customer. The dispenser may be configured to retract the first tangible item. The SSK may include an acceptor configured to receive a second tangible item. The second tangible item may be received from the customer. The SSK may include a validator configured to examine the first tangible item and the second tangible item.

The SSK may include a bridge configured to transfer the first tangible item. The bridge may be configured to transfer the second tangible item. The bridge may link the acceptor, the validator and the dispenser. The bridge may transfer one or more tangible items to the validator.

The first tangible item may be one of a plurality of first tangible items. The dispenser may be configured to present the plurality of first tangible items to the customer. The bridge may be configured to transfer one or more of the plurality of first tangible items to the validator after the one or more of the plurality of first tangible items are retracted by the dispenser.

The SSK may include a cash cassette. The cash cassette may store cash available to be dispensed by the SSK. The cash cassette may be filled by an entity other than the operator of the SSK. For example, the cash cassette may be loaded by armored personnel and services typically employed to deliver cash to an ATM. The SSK may include a purge-bin. The purge-bin may store currency retracted by the dispenser.

The SSK may include a validator bridge. The validator bridge may link the validator, the cash cassette and the purge-bin. A tangible item may be transferred from the validator to the purge-bin over the validator bridge. The purge-bin and the cash cassette may "share" the validator. The dispenser, the acceptor, the purge-bin and the cash cassette may all "share" one validator.

A tangible item extracted from the cash cassette may be transferred over the validator bridge to the validator. The validator bridge may be configured to transfer the first tangible item from the cash cassette to the dispenser via the validator. The validator bridge may be configured to transfer the tangible item from the dispenser to the purge-bin via the validator.

The first tangible item may be one of a plurality of tangible items. The SSK may include a processor configured to compare a first number of tangible items transferred from the cash cassette to the dispenser and a second number of tangible items transferred from the dispenser to the purge-bin. The first number of tangible items may correspond to a number of bills dispensed by the SSK in response to a request received from a customer. The second number of tangible items may correspond to a number of bills retracted by the SSK.

The validator may be configured to perform a first examination routine. The first examination routine may be performed in response to a retraction of a tangible item. The validator may be configured to perform a second examination routine. The second examination routine may be performed when a tangible item is received by the acceptor. The validator may be configured to perform a third examination routine. The third examination routine may be performed when a tangible item is transferred from the cash cassette to the dispenser.

Methods of reducing fraud at a SSK are provided. The methods may include examining a first amount of money. The first amount of money may be deposited into the SSK. The first amount of money may be received at an acceptor of the SSK. The first amount of money may be examined using a validator. The examination of money may include authenticating the first amount of money. The SSK may include the validator.

The methods may include dispensing a second amount of money to a customer. The second amount of money may be extracted from a cash cassette. The SSK may include the cash cassette. The methods may include retracting at least a portion of the second amount of money. The portion of the second amount of money may be retracted if the customer does not retrieve all the money dispensed.

The methods may include transferring the portion of the second amount of money to the validator. The methods may include examining the portion of the second amount of money. The examining may be performed using the validator. The methods may include transferring the portion of the second amount of money from the validator to a purge-bin. The SSK may include the purge-bin.

The methods may include transferring the first amount of money along a bridge. The bridge may mechanically link the validator and the acceptor. The bridge may mechanically link the validator and the dispenser. The methods may include transferring the portion of the second amount of money along at least a segment of the bridge.

The bridge may include rollers. The rollers may move money along a length of the bridge. The bridge may include any suitable mechanism for moving money along the length of the bridge. The bridge may include a fork. The fork may join the dispenser and the acceptor to the validator.

The methods may include transferring the first amount of money along a first bridge. The first bridge may mechanically link the validator and the acceptor. The methods may include transferring the portion of the second amount along a second bridge mechanically linking the validator and a dispenser.

For example, the first bridge and the second bridge may intersect at the validator. The validator may be configured to examine a tangible item regardless of an orientation of the tangible item. The validator may be configured to examine a first tangible item in a first orientation and a second tangible time in a second orientation. The second orientation may be perpendicular to the first orientation. The second orientation may be at any suitable angle to the first orientation.

Examining the portion of the second amount of money may include determining a value of the portion of the second amount of money. Examining the portion of the second amount of money may include identifying a denomination of each bill in the portion of the second amount of money. Examining the portion of the second amount of money may include authenticating each bill in the portion of the second amount of money. The authentication may include determining a risk that each bill is counterfeit.

The examining may include associating a time and date of a retracting with a transaction identifier. The transaction identifier may correspond to a dispensing of the second amount of money to the customer. The transaction identifier may correspond to any suitable SSK transaction.

The methods may include generating a fraud record. The fraud record may include a date and time of a retracting. The fraud record may include a transaction identifier that is related to the date and time.

For example, based on a time of a retracting, the methods may associate the retracting with a withdrawal request. The withdrawal request may have been submitted prior to the retraction.

Based on the withdrawal request, the methods may identify a customer associated with the retraction. For example, the withdrawal request may include a customer account number. The customer account number may be associated with a name and/or address of a customer.

The fraud record may include a first value. The first value may be associated with a dispensing. For example, the first value may correspond to a value of cash dispensed by a SSK. The fraud record may include a second value associated with a retracting. For example, the second value may correspond to a value of cash retracted by the SSK.

The fraud record may include a difference between the first value and the second value. The difference may correspond to a value of cash estimated to have been withdrawn from the SSK.

The methods may include receiving a mis-dispense claim from the customer. The mis-dispense claim may allege that the customer is owed an amount greater than the difference between the first value and the second value. In response to receiving the mis-dispense claim, the methods may include transmitting the fraud record to the customer or a fraud investigation unit of a financial entity. In response to receiving the mis-dispense claim, the methods may include informing the customer that an amount of cash corresponding to the difference was withdrawn from the SSK.

Illustrative embodiments of apparatus and methods in accordance with the principles of the invention will now be described with reference to the accompanying drawings, which form a part hereof. It is to be understood that other embodiments may be utilized and structural, functional and procedural modifications may be made without departing from the scope and spirit of the present invention.

As will be appreciated by one of skill in the art, the invention described herein may be embodied in whole or in part as a method, a data processing system, or a computer program product. Accordingly, the invention may take the form of an entirely hardware embodiment, an entirely software embodiment or an embodiment combining software, hardware and any other suitable approach or apparatus.

Furthermore, such aspects may take the form of a computer program product stored by one or more computer-readable storage media having computer-readable program code, or instructions, embodied in or on the storage media. Any suitable computer readable storage media may be utilized, including hard disks, CD-ROMs, optical storage devices, magnetic storage devices, and/or any combination thereof. In addition, various signals representing data or events as described herein may be transferred between a source and a destination in the form of electromagnetic waves traveling through signal-conducting media such as metal wires, optical fibers, and/or wireless transmission media (e.g., air and/or space).

FIG. 1 shows illustrative self-service device 100. Self-service device 100 may be an ATM. Self-service device 100 may include monitor 102, keypad 104, card reader port 106, acceptor 108, item dispenser 110 and security screen 112.

Monitor 102 may exchange visual and or audio information with a customer. Keypad 104 may include alphanumeric keys 114 for the customer to enter numerical and textual data. Keypad 104 may include control keys 116. In some embodiments, control keys 116 may be used to communicate control information, such as instructions, to self-service device 100. Keypad 104 may include soft keys 118. Soft keys 118 may have functions that are dictated by programming and are presented to the customer using information that may be displayed on monitor 102.

Card reader port 106 may be the front end of any suitable card reader. The card reader may read magnetically encoded information on transaction instruments such as bank cards. In some embodiments (not shown), self-service device 100 may include a contactless chip reader, a wireless transceiver or any other suitable interface for exchanging transaction information with a transaction instrument. The transaction instrument may be a chip, an RFID tag, a smart card, a PDA, a telephone or any other suitable device.

In some embodiments, self-service device 100 may include a biometric sensor (not shown). The biometric sensor may identify a customer based on a feature, such as an anatomical feature, of the customer. For example, the biometric sensor may be configured to identify the customer based on all or part of a face, a fingerprint, an iris, a retina, a hand or any other suitable anatomical feature. The biometric sensor may identify the customer based on a behavioral feature such as a signature, a voice, a gait or any other suitable behavioral feature.

Acceptor 108 may accept any suitable tangible item. For example, acceptor 108 may accept envelopes, deposit forms, bills, checks or any other suitable documents. In some embodiments, acceptor 108 may feed into a scanner that digitizes a tangible item for image-based transaction processing.

Item dispenser 110 may dispense tangible items. For example, item dispenser 110 may dispense bills.

Security screen 112 may visually screen a surveillance device (not shown). The surveillance device may provide video information about individuals that are present near the self-service device. The surveillance device may provide video information about conditions near the self-service device.

Figure 2:
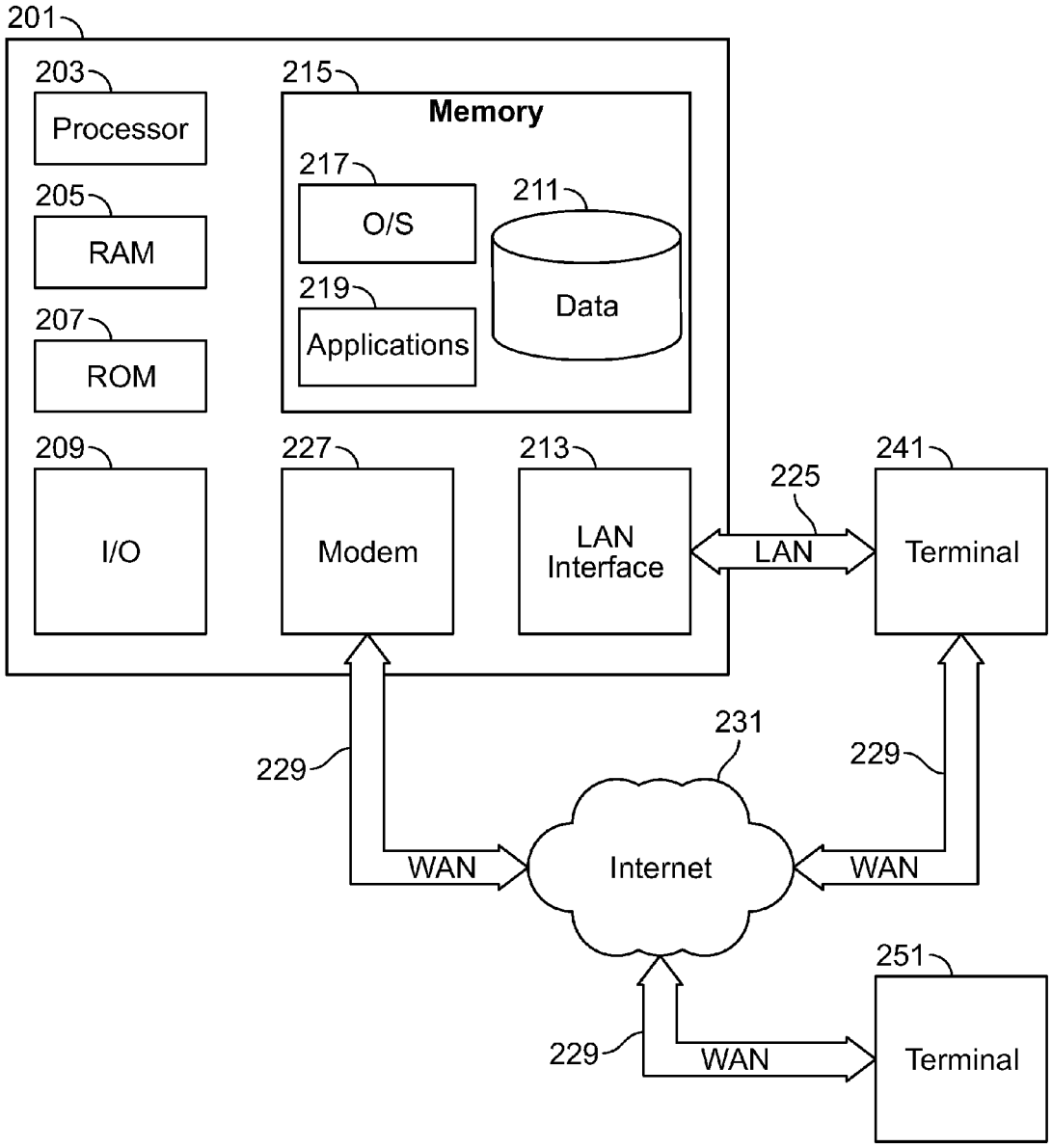
FIG. 2 shows an illustrative apparatus in accordance with principles of the invention.

FIG. 2 is a block diagram that illustrates a generic computing device 201 (alternatively referred to herein as a "server") that may be used according to an illustrative embodiment of the invention. The computer server 201 may have a processor 203 for controlling overall operation of the server and its associated components, including RAM 205, ROM 207, input/output ("I/O") module 209, and memory 215.

I/O module 209 may include a microphone, keypad, touch screen and/or stylus through which a user of device 201 may provide input, and may also include one or more of a speaker for providing audio output and a video display device for providing textual, audiovisual and/or graphical output. Software may be stored within memory 215 and/or other storage (not shown) to provide instructions to processor 203 for enabling server 201 to perform various functions. For example, memory 215 may store software used by server 201, such as an operating system 217, application programs 219, and an associated database 211. Alternatively, some or all of server 201 computer executable instructions may be embodied in hardware or firmware (not shown).

Server 201 may operate in a networked environment supporting connections to one or more remote computers, such as terminals 241 and 251. Terminals 241 and 251 may be personal computers or servers that include many or all of the elements described above relative to server 201. The network connections depicted in FIG. 2 include a local area network (LAN) 225 and a wide area network (WAN) 229, but may also include other networks. When used in a LAN networking environment, computer 201 is connected to LAN 225 through a network interface or adapter 213. When used in a WAN networking environment, server 201 may include a modem 227 or other means for establishing communications over WAN 229, such as Internet 231.

It will be appreciated that the network connections shown are illustrative and other means of establishing a communications link between the computers may be used. The existence of any of various well-known protocols such as TCP/IP, Ethernet, FTP, HTTP and the like is presumed, and the system can be operated in a client-server configuration to permit a user to retrieve web pages from a web-based server. Any of various conventional web browsers can be used to display and manipulate data on web pages.

Additionally, application program 219, which may be used by server 201, may include computer executable instructions for invoking user functionality related to communication, such as email, short message service (SMS), and voice input and speech recognition applications.

Computing device 201 and/or terminals 241 or 251 may also be mobile terminals including various other components, such as a battery, speaker, and antennas (not shown).

Terminal 251 and/or terminal 241 may be portable devices such as a laptop, tablet, smartphone or any other suitable device for storing, transmitting and/or transporting relevant information.

Any information described above in connection with database 211, and any other suitable information, may be stored in memory 215.

One or more of applications 219 may include one or more algorithms that may be used to transfer a tangible item, examine a tangible item, determine relationship between transactions and/or any other suitable tasks related to transferring a tangible item over a bridge linking two or more SSK components.

The invention may be operational with numerous other general purpose or special purpose computing system environments or configurations. Examples of well-known computing systems, environments, and/or configurations that may be suitable for use with the invention include, but are not limited to, personal computers, server computers, hand-held or laptop devices, tablets, mobile phones and/or other personal digital assistants ("PDAs"), multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices.

Figure 3:
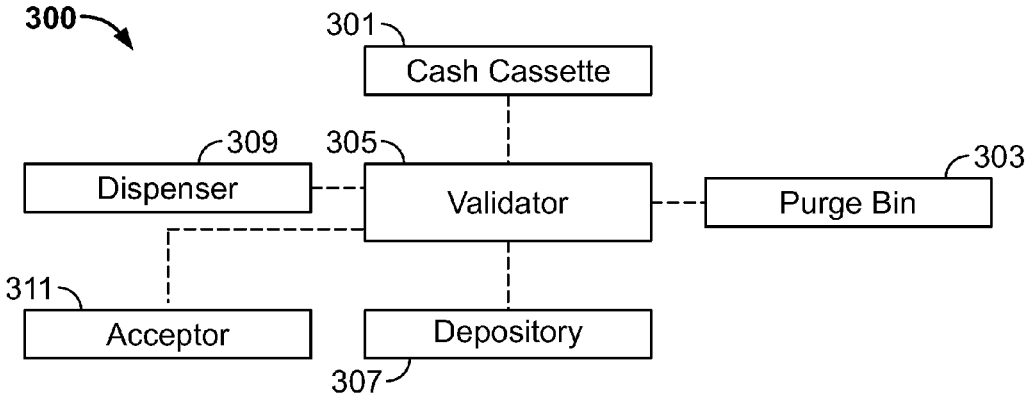
FIG. 3 shows an illustrative apparatus in accordance with principles of the invention.

FIG. 3 shows illustrative components of a self-service kiosk ("SSK"). The SSK may include one or more features of device 100 (shown in FIG. 1). Components 300 may include cash cassette 301. Cash cassette 301 may store tangible items available to be dispensed by the SSK. For example, cash cassette 301 may store cash in one or more denominations. Cash may be extracted from cash cassette 301 and transferred to validator 305.

Validator 305 may examine the extracted cash. For example, validator 305 may determine whether the tangible item extracted from cash cassette 301 is currency. A non-currency item may be loaded into cash cassette 301 as a result of a process breakdown or human error.

The cash may be transferred from validator 305 to dispenser 309. Dispenser 309 may present the cash to a user of the SSK. Dispenser 309 may retract cash that is not collected by the user. The retracted cash may be transferred to validator 305. Validator 305 may determine a denomination of each bill included in the retracted cash. The retracted cash may be transferred from validator 305 to purge-bin 303.

Cash stored in purge-bin 303 may be removed from the SSK. Purge-bin 303 may be removable from the SSK. Cash removed from purge-bin 303 may recirculate by loading the cash into cash cassette 301.

Components 300 include acceptor 311. Acceptor 311 may accept one or more tangible items deposited by a user of the SSK. For example, the user may deposit cash or checks into acceptor 311. The tangible item inserted into acceptor 311 may be transferred to validator 305. Validator 305 may examine the inserted tangible item.

For example, validator 305 may identify a routing number and/or an account number on a deposited check. Validator 305 may examine cash for one or more features of the cash. Validator 305 may determine a currency and/or denomination associated with the deposited cash. Validator 305 may examine cash for one or more known security features. Examining the cash for known security features may reduce a risk of accepting a deposit that includes counterfeit cash.

The deposited cash may be transferred from validator 305 to depository 307. The deposited cash may be stored in depository 307. Depository 307 may be removable from the SSK.

Figure 4:
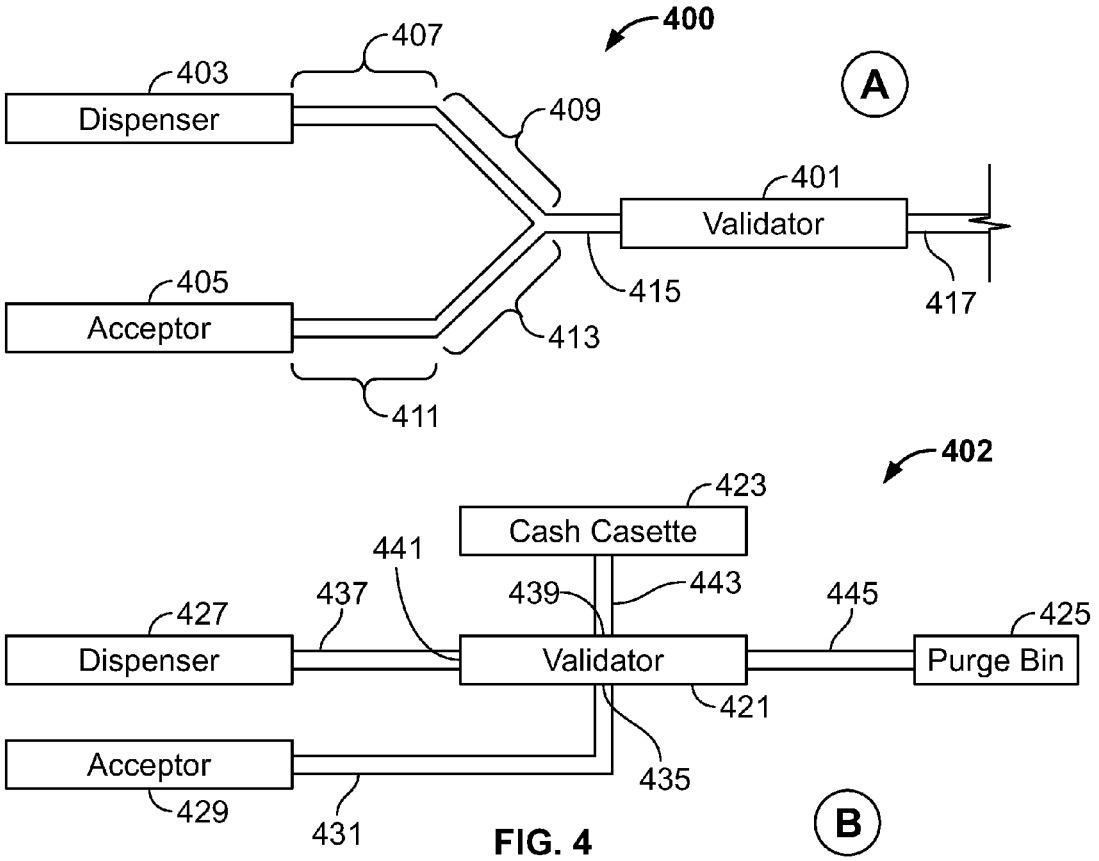
FIG. 4 shows an illustrative apparatus in accordance with principles of the invention.

FIG. 4A shows a schematic diagram of hardware apparatus 400. Device 100 (shown in FIG. 1) may include one or more features of apparatus 400. Apparatus 400 includes validator 401. Validator 401 may include one or more features of validator 305 (shown in FIG. 3).

Apparatus 400 includes dispenser 403. Dispenser 403 may include one or more features of dispenser 309 (shown in FIG. 3). Validator 401 may be linked to dispenser 403 via bridge 415. Bridge 415 may include one or more segments, such as illustrative segments 407 and 409. Bridge 415 may be configured to transfer one or more tangible items between validator 401 and dispenser 403. For example, bridge 415 may transfer cash retracted by dispenser 403 to validator 401 via bridge 415.

Apparatus 400 includes acceptor 405. Acceptor 405 may include one or more features of acceptor 311 (shown in FIG. 3). Validator 401 may be linked to acceptor 405 via bridge 415. Bridge 415 includes illustrative segments 411 and 413.

Using bridge 415, tangible items may be transferred from validator 401 to dispenser 403. Using bridge 415, tangible items may be transferred from dispenser 403 to validator 401. Using bridge 415, tangible items may be transferred from acceptor 405 to dispenser 403. Using bridge 415, tangible items may be transferred from validator 401 to acceptor 405.

For example, a tangible item deposited into acceptor 405 may be transferred to validator 401 via bridge 415. Validator 401 may examine the deposited item. As a result of the examination, validator 401 may reject the deposited tangible item. The rejected deposit may be transferred from validator 401 to acceptor 405 via bridge 415.

In some embodiments, a SSK such as device 100 (shown in FIG. 1) may include a combination acceptor/dispenser. The combination acceptor/dispenser may be linked to a validator such as validator 401 using a bridge such as bridge 415. The bridge linking the combination acceptor/dispenser may not include segments 407, 409, 411 and 413. For example, the bridge may only include segments 407 and 409.

In some embodiments, a SSK such as ATM 100 (shown in FIG. 1) may not include acceptor 405. In such embodiments, bridge 415 may not include segments 411 and 413.

Validator 401 may be linked to one more additional components (not shown) via bridge segment 417. For example, bridge segment 417 may link validator 401 to a purge-bin such as purge-bin 303, a cash cassette such as cash cassette 301, and/or a depository such as depository 307 (shown in FIG. 3).

FIG. 4B shows a schematic diagram of hardware apparatus 402. Apparatus 402 includes validator 421. Validator 421 may include one more features of validator 305 (shown in FIG. 3). Apparatus 402 includes acceptor 429. Acceptor 429 may include one or more features of acceptor 311 (shown in FIG. 3). Acceptor 429 is linked to validator 421 via acceptor bridge 431.

Acceptor bridge 431 may be configured to transfer one or more tangible items between acceptor 429 and validator 421. Validator 421 may include receiving end 435. Receiving end 435 may receive a tangible item transferred via acceptor bridge 431. Acceptor bridge 431 may link acceptor 429 to receiving end 435. Acceptor bridge 431 may transfer one or more tangible items bi-directionally between acceptor 429 and validator 421.

Apparatus 402 includes dispenser 427. Dispenser 427 may include one or more features of dispenser 309 (shown in FIG. 3). Dispenser 427 is linked to validator 421 via dispenser bridge 437.

Dispenser bridge 437 may be configured to transfer one or more tangible items between dispenser 427 and validator 421. Validator 421 may include receiving end 441. Receiving end 441 may receive a tangible item transferred via dispenser bridge 437. Dispenser bridge 437 may link dispenser 427 to receiving end 441. Dispenser bridge 437 may transfer one or more tangible items bi-directionally between dispenser 427 and validator 421.

Apparatus 402 includes cash cassette 423. Cash cassette 423 may include one or more features of cash cassette 301 (shown in FIG. 3). Cash cassette 423 is linked to validator 421 via validator bridge segment 443.

Validator bridge segment 443 may be configured to transfer to transfer one or more tangible items between cash cassette 423 and validator 421. Validator 421 may include receiving end 439. Receiving end 439 may receive a tangible item transferred via validator bridge segment 443. Validator bridge segment 443 may link cash cassette 423 to receiving end 439.

Validator bridge segment 443 may transfer one or more tangible items bi-directionally between cash cassette 423 and validator 421. For example, upon detection of a non-currency item, validator bridge segment 443 may transfer the non-currency item from validator 421 to cash cassette 423. Cash cassette 423 may include a storage space for items extracted from cash cassette 423 and rejected by validator 421.

Apparatus 402 includes purge-bin 425. Purge-bin 425 may include one or more features of purge-bin 303 (shown in FIG. 3). Purge-bin 425 is linked to validator 421 via validator bridge segment 445. Validator bridge segment 445 may be configured to transfer to transfer one or more tangible items between purge-bin 425 and validator 421.

Validator bridge segment 445 may be configured to transfer one or more tangible items retracted by dispenser 427. Validator bridge segment 445 may be configured to transfer one or more tangible items extracted from cash cassette 423.

Figure 5:
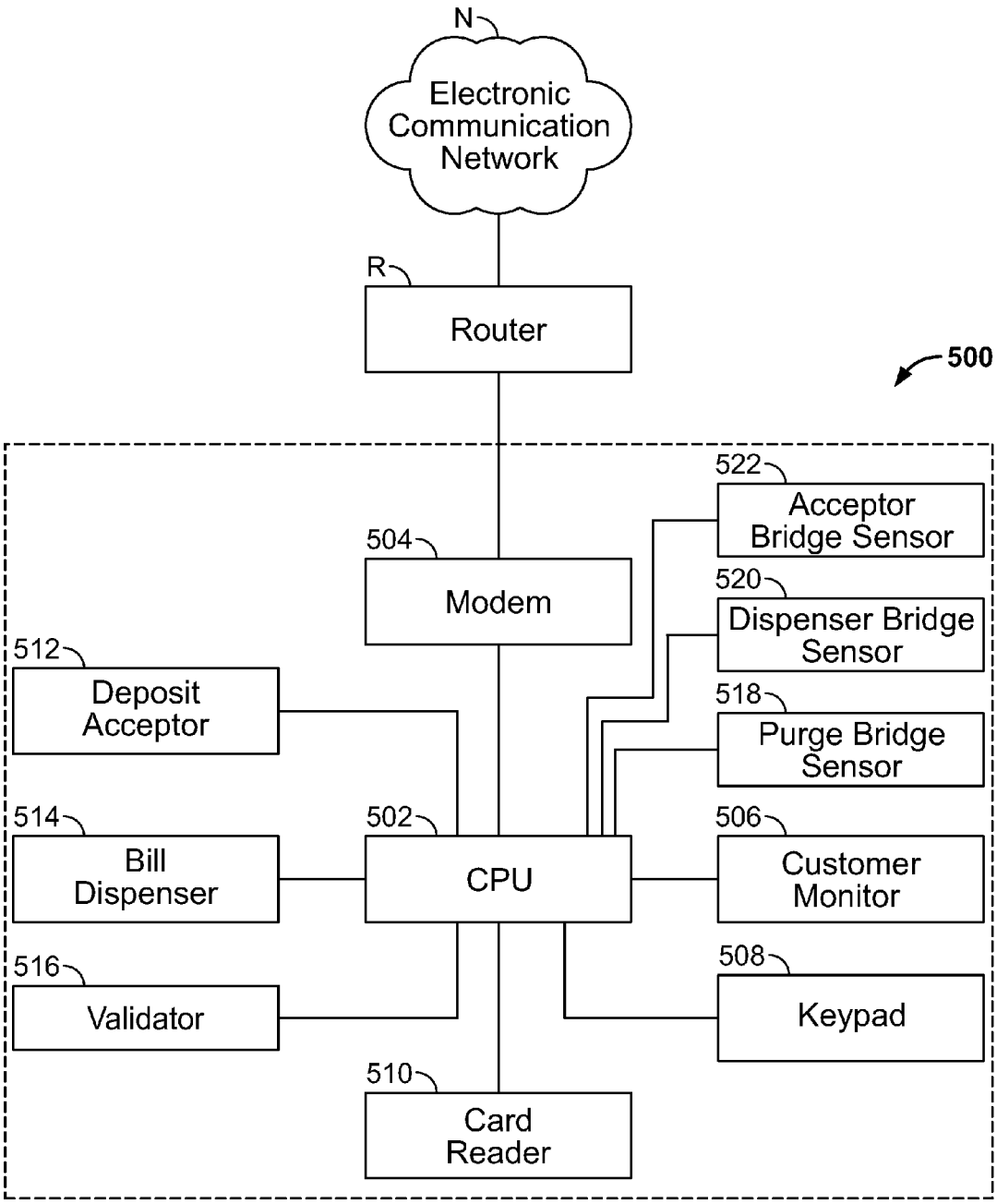
FIG. 5 shows an illustrative apparatus in accordance with principles of the invention.

FIG. 5 shows illustrative apparatus 500. Apparatus 500 may include a control system for controlling a self-service kiosk such as device 100 (shown in FIG. 1). Apparatus 500 may be controlled by CPU 502. CPU 502 may include one or more features of server 201 (shown in FIG. 2). CPU 502 may exchange information with electronic communication network N via modem 504, which is in communication with router R. The information may include transaction information.

CPU 502 may receive information from a customer via monitor 506, keypad 508, card reader 510, acceptor 512 or bill dispenser 514.

CPU 502 may instruct a SSK to dispense bills through bill dispenser 514. CPU 502 may instruct bill dispenser 514 to retract any currency remaining in bill dispenser 514 after expiration of a time-out period.

CPU 502 may receive information from dispenser bridge sensor 520. Dispenser bridge sensor 520 may detect a presence of one or more tangible items being transferred via a dispenser bridge, such as bridge 415 (shown in FIG. 4A) or dispenser bridge 437 (shown in FIG. 4B). Dispenser bridge sensor 520 may detect if one or more tangible items is "stuck" on the dispenser bridge.

CPU 502 may receive request to deposit bills. CPU 502 may transmit information to acceptor 512 instructing acceptor 512 to accept one or more tangible items inserted into acceptor 512.

CPU 502 may receive information from acceptor bridge sensor 522. Acceptor bridge sensor 522 may detect a presence of one or more tangible items being transferred via an acceptor bridge, such as bridge 415 (shown in FIG. 4A) or acceptor bridge 431 (shown in FIG. 4B). Acceptor bridge sensor 522 may detect if one or more tangible items is "stuck" on the acceptor bridge.

CPU 502 may receive information from purge bridge sensor 518. Purge bridge sensor 518 may detect a presence of one or more tangible items being transferred via a purge bridge, such as bridge segment 445 (shown in FIG. 4B).

CPU 502 may receive information from validator 516. CPU 502 may process the information received from validator 516. CPU 502 may receive a result of an examination performed by validator 516. CPU 502 may determine which examination routine should be performed by validator 516. CPU 502 may transmit information received from validator 516 onto electronic network N via modem 504 and router R.

Figure 6:
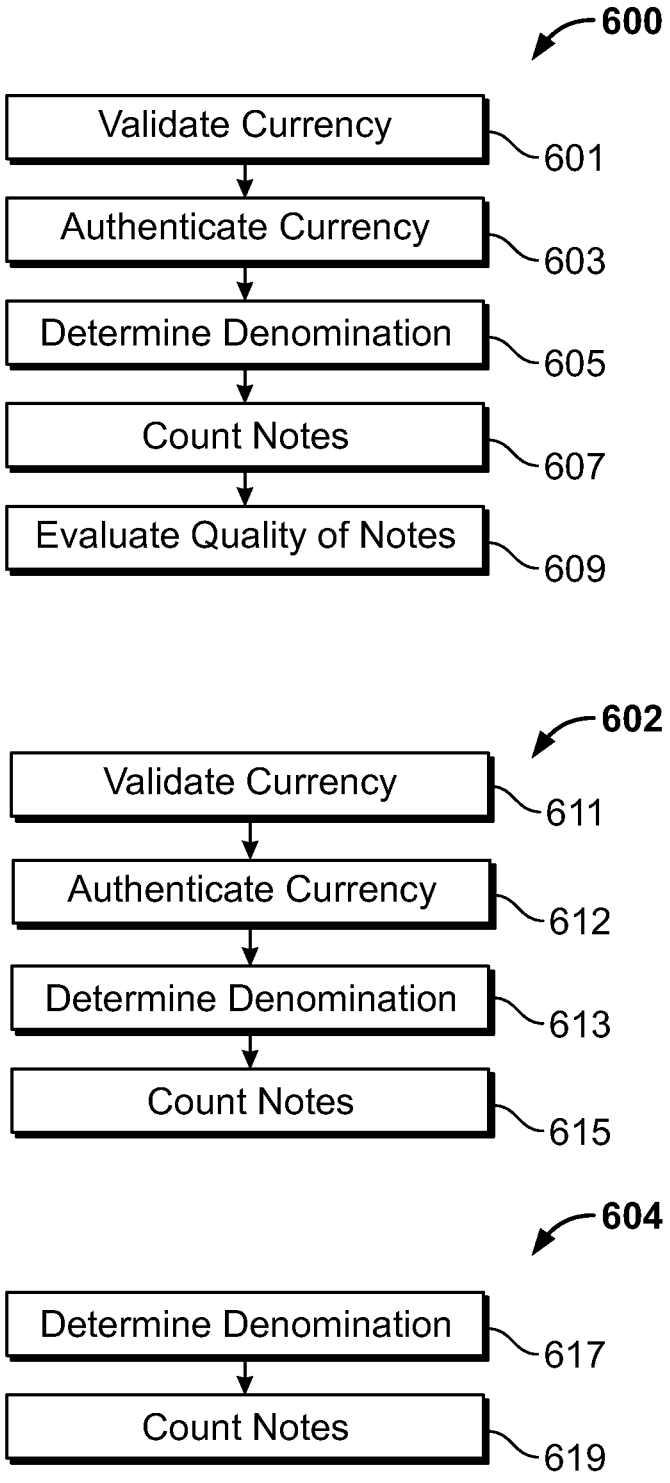
FIG. 6 shows an illustrative process in accordance with principles of the invention.

FIG. 6 shows illustrative examination routines 600, 602 and 604. For the sake of illustration, the steps of the process illustrated in FIG. 6 will be described as being performed by a "system." The "system" may include one or more of the features of the apparatus that are shown in FIGS. 1-5 and/or any other suitable device or approach. For example, examination routines 600, 602 or 604 may be executed by a validator, such as validators 305 (shown in FIG. 3), 401 (shown in FIG. 4A), 421 (shown in FIG. 4B) and/or 516 (shown in FIG. 5). The "system" may be provided by an entity. The entity may be an individual, an organization or any other suitable entity.

Examination routine 600 includes five steps. At step 601, the system validates currency. The currency may be received from an acceptor, such as acceptor 108 (shown in FIG. 1) or acceptor 311 (shown in FIG. 3). Validating the currency may include identifying a deposited tangible item as currency.

At step 603, the system determines an authenticity of a tangible item. Determining authenticity may include attempting to identify a counterfeit or forged tangible item. The tangible item may be any suitable tangible item. Authenticity may be determined by communicating detected characteristics of a deposited item to a remote network, such as network N (shown in FIG. 5). Authenticity may be determined by comparing one or more features of a deposited item to features stored in a database such as database 211 (shown in FIG. 2).

At step 605, the system determines a denomination of the tangible item. For example, the system may determine if the tangible item is a $10 dollar-bill or a $20 dollar-bill. At step 607, the system counts two or more tangible items. For example, the system may determine how many $20 dollar-bills are transferred via a dispenser bridge to a validator.

At step 609, the system may evaluate a quality of the tangible items. For example, if cash is deposited by a customer into a SSK, step 609 may determine whether cash is of a threshold quality. Quality may be evaluated based on discoloration of the cash discoloration or tears in the cash.

Examination routine 600 may be performed by a validator in response to receiving a tangible item from an acceptor. Tangible items received from an acceptor may be subject to a five step examination routine, such as routine 600.

Examination routine 602 includes four steps. At step 611, the system validates currency. At step 612, the system authenticates currency. At step 613, the system determines a denomination of currency. At step 615, the system counts notes.

Examination routine 602 may be performed by a validator in response to receiving a tangible item from a cash cassette. Performing examination routine 602 prior to dispensing a tangible item may prevent items erroneously loaded into the cash cassette from being dispensed to a customer. Tangible items received from a cash cassette may be subject to a four step examination routine, such as routine 602. Examination routine 602 may be performed in less time than examination routine 600.

Examination routine 604 includes two steps. At step 617, the system determines a denomination of one or more tangible items. At step 619, the system counts two or tangible items.

Examination routine 604 may be performed by a validator in response to retracting a tangible item from a dispenser. Performing examination routine 604 prior to storing a retracted tangible item may enable the system to detect and record one or more features of the retracted items. Retracted tangible items by may be subject to a two-step examination routine, such as routine 604. Examination routine 604 may be performed in less time than examination routines 600 or 602.

Figure 7:
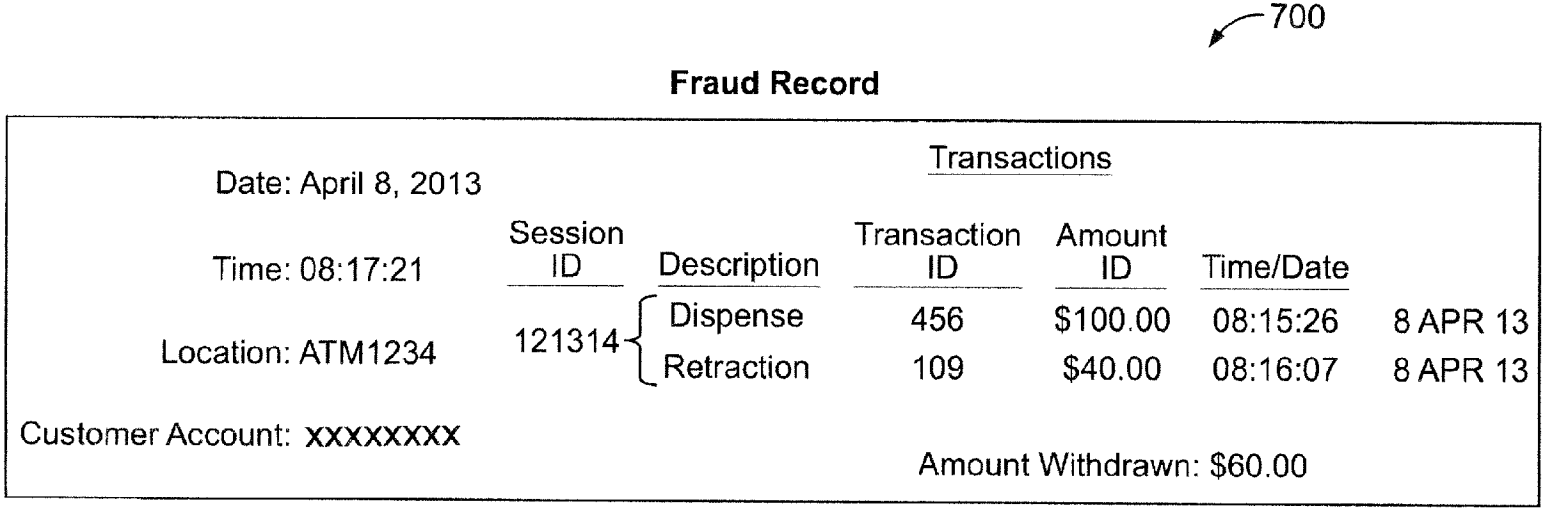
FIG. 7 shows illustrative information in accordance with principles of the invention.

FIG. 7 shows illustrative information 700. Information 700 may be collated into a fraud record. The fraud record may include transaction detail associated with a SSK session. The SSK may relate one or more actions performed by the SSK. The one or more actions may each be associated with a customer or a set of customer credentials.

The fraud record may list one or more transactions conducted during the SSK session. The fraud record may include transaction details determined by a validator. Based on the fraud record, an entity may be prepared to respond to mis-dispense claims associated with one or more actions performed by the SSK during a SSK session.

The fraud record may show a relationship between two or more transactions. For example, information 700 shows that a dispensing and a retracting are temporally related based on a difference in time between the dispensing and the retracting. Information 700 also shows that the dispensing and the retracting occurred during one "session ID."

Figure 8:
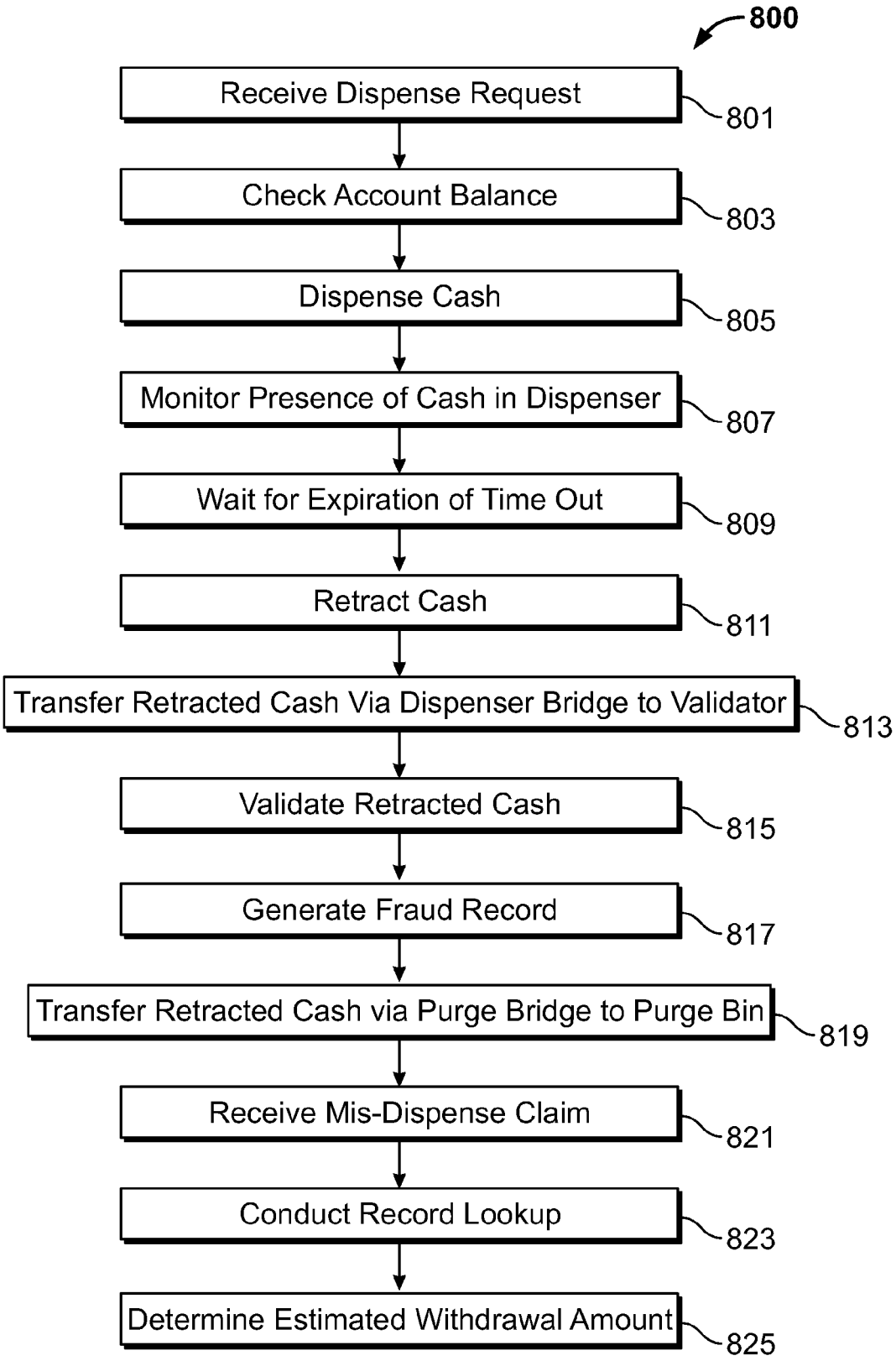
FIG. 8 shows an illustrative process in accordance with principles of the invention.

FIG. 8 shows illustrative process 800. For the sake of illustration, the steps of the process illustrated in FIG. 8 will be described as being performed by a "system." The "system" may include one or more of the features of the apparatus that are shown in FIGS. 1-5 and/or any other suitable device or approach. The "system" may utilize one or more of the features of the processes shown in FIG. 6, information shown in FIG. 7 and/or any other suitable approach. The "system" may be provided by an entity. The entity may be an individual, an organization or any other suitable entity.

At step 801, the system may receive a dispense request. The request may be received from a customer. At step 803, the system may check an account balance of the customer. At step 805, the system may dispense cash. The cash may be retrieved from a cash cassette. At step 807, the system may monitor presence of cash in a dispenser. The system may detect whether the dispensed cash is removed from the dispenser.

At step 809, the system may wait for expiration of a time-out period before retracting cash remaining in the dispenser. The time-out period may be determined based on an average amount of time for a customer to be aware that cash has been dispensed and to remove the cash from the dispenser.

At step 811, the system may retract uncollected cash. At step 813, the uncollected cash is transferred, via dispenser bridge, to a validator. At step 815, the system validates the retracted cash. The validation may include counting a number of uncollected items and determining a denomination of each of the uncollected items.

At step 817 the system generates a fraud record. The fraud record may be based on the validation performed at step 815. The fraud record may include information logged in one or more databases. The fraud record may include one or more features of information 700 (shown in FIG. 7). At step 819, the uncollected cash is transferred, via a purge bridge, from the validator to a purge bin.

At step 821, the system receives a mis-dispense claim. The mis-dispense claim may allege that a SSK did not dispense a requested number or amount of tangible items. At step 823, in response to receiving the mis-dispense claim, the system may conduct a record lookup. The record lookup may determine if one or more details included in the mis-dispense claim may be related to one or more fraud records.

For example, the mis-dispense claim may include a date, name or amount of money. At step 823, the system may search for one or more fraud records that include the date, name or amount. The system may look-up names associated with one or more account numbers included in a fraud record.

At step 825, the system determines an estimated withdrawal amount. The estimated withdrawal amount may be an amount of money estimated to have been collected by a SSK user. The estimated withdrawal amount may correspond to a difference between an amount of cash dispensed at step 805 and an amount of cash retracted at step 811. The amount of cash retracted at step 811 may be determined by the system at step 815. Based on the estimated withdrawal amount, the entity may deny the mis-dispense claim. Based on the estimated withdrawal amount, the entity may offer to compensate the SSK user less than an amount of money claimed by the SSK user in the mis-dispense claim.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures. In this regard, other embodiments are disclosed herein as well that can be partially or wholly implemented on a computer-readable medium, for example, by storing computer-executable instructions or modules or by utilizing computer-readable data structures.

Thus, systems and methods for a self-service kiosk validator bridge have been provided. Persons skilled in the art will appreciate that the present invention can be practiced by other than the described embodiments, which are presented for purposes of illustration rather than of limitation. The present invention is limited only by the claims that follow.

What is claimed is:

1. A self-service kiosk comprising:

a validator configured to examine one or more tangible items;

an acceptor configured to accept a first tangible item deposited by a customer;

a dispenser configured to:

present a second tangible item to the customer; and retract the second tangible item; and a dispenser bridge mechanically linking the dispenser, the acceptor and the validator, the dispenser bridge comprising a forked transfer path;

wherein:

a first branch of the forked transfer path is configured to transfer a deposited first tangible item from the acceptor to the validator; and a second branch of the forked transfer path is configured to transfer a retracted second tangible item from the dispenser to the validator; and wherein the first branch and the second branch are bidirectional transfer paths.

2. The self-service kiosk of claim 1 further comprising a purge-bridge mechanically linking the validator and a purge bin, the purge-bridge configured to transfer the tangible item from the validator to the purge-bin.

3. The self-service kiosk of claim 1 wherein the dispenser bridge comprises a sensor, the sensor configured to:

detect the retracted tangible item or the deposited tangible item; and register a time and date of the transfer of the detected tangible item.

4. The self-service kiosk of claim 1 further comprising a processor, the processor configured to:

determine a relationship between:

a first transaction identifier associated with a first amount of currency presented to the customer using the dispenser;

a second transaction identifier associated with a second amount of retracted currency transferred over the dispenser bridge; and a customer account; and generate a fraud record, the fraud record comprising:

the customer account;

the first amount of currency;

the second amount of currency; and a difference between the first amount and the second amount.

5. The self-service kiosk of claim 1 wherein the validator is further configured to perform:

a first examination routine when the deposit is transferred via the first branch; and a second examination routine when the tangible item is transferred via the second branch.

6. The self-service kiosk of claim 1 wherein the tangible item is:

money;

an event ticket; or a transportation ticket.

7. The self-service kiosk of claim 1:

the validator comprising:

a first currency receiver; and a second currency receiver;

the first branch is affixed to the first currency receiver; and the second branch is affixed to the second currency receiver;

wherein, the deposit of the customer is transferred over the first branch to the validator via the first currency receiver; and wherein, when the tangible item is retracted by the dispenser, the tangible item is transferred over the second branch to the validator via the second currency receiver.

8. A self-service kiosk comprising:

a dispenser configured to:

present a first tangible item to a customer; and retract the first tangible item;

an acceptor configured to receive a second tangible item from the customer;

a validator configured to examine:

the first tangible item; and the second tangible item; and a bridge comprising a forked transmission path, the bridge configured to transfer:

the first tangible item retracted by the dispenser from the dispenser to the validator using a first branch of the forked transmission path; and the second tangible item received by the acceptor from the acceptor to the validator using a second branch of the forked transmission path.

9. The self-service kiosk of claim 8 wherein, the bridge links:

the acceptor;

the validator; and the dispenser.

10. The self-service kiosk of claim 9, when the first tangible item is one of a plurality of first tangible items:

the dispenser is configured to:

present the plurality of first tangible items to the customer; and retract one or more of the plurality of first tangible items; and the bridge is configured to transfer the one or more of the plurality of first tangible items to the validator using the first branch.

11. The self-service kiosk of claim 8 further comprising:

a cash cassette;

a purge-bin; and a validator bridge, the validator bridge mechanically linking:

the validator;

the cash cassette; and the purge-bin.

12. The self-service kiosk of claim 11 wherein the validator bridge is configured to transfer the first tangible item:

from the cash cassette to the dispenser via the validator; and from the dispenser to the purge-bin via the validator.

13. The self-service kiosk of claim 12 comprising a processor configured to compare, when the first tangible item is one of a plurality of first tangible items:

a first number of the plurality of first tangible items transferred from the cash cassette to the dispenser; and a second number of the plurality of first tangible items transferred from the dispenser to the purge-bin.

14. The self-service kiosk of claim 11 wherein the validator is further configured to perform:

a first examination routine in response to the first tangible item being retracted by the dispenser;

a second examination routine in response to the second tangible item being received by the acceptor; and a third examination routine in response to the first tangible item being transferred from the cash cassette.

15. A method for reducing fraud at a self-service kiosk ("SSK"), the method comprising:

using a dispenser of the SSK, dispensing a first amount of money to a customer;

using the dispenser of the SSK, retracting at least a portion of the first amount of money;

using a bridge, transferring the portion of the first amount of money from the dispenser to a validator over a first branch of the bridge;

using the validator, examining the portion of the first amount of money;

using the bridge, transferring the portion of the first amount of money from the validator to a purge-bin over a second branch of the bridge;

using an acceptor of the SSK, receiving a second amount of money deposited by the customer;

using the bridge, transferring the second amount of money from the acceptor of the SSK to the validator over a third branch of the bridge; and using the validator of the SSK, examining the second amount of money deposited into the self-service kiosk;

wherein the first branch and the third branch are bidirectional transfer paths.

16. The method of claim 15 wherein the examining the portion of the first amount of money comprises:

identifying a denomination of each bill comprising the portion of the first amount of money;

determining a value of the portion of the first amount of money; and associating a time and date of the retracting with a transaction identifier, the transaction identifier corresponding to the dispensing of the first amount of money to the customer.

17. The method of claim 15 further comprising:

using a computer system, receiving a mis-dispense claim from the customer; and in response to receiving the mis-dispense claim, using the computer system to:

generate a fraud record; and transmit the fraud record; wherein the fraud record comprises:

a date and time of the retracting;

a transaction identifier correlated to the date and time;

a first value associated with the dispensing;

a second value associated with the retracting; and a difference between the first value and the second value.

18. The method of claim 15, further comprising, in response to examining the portion of the first amount of money, debiting an account of the customer a monetary value corresponding to a difference between:

a first value of the first amount of money; and a second value of the portion of the first amount of money.

* * * * *